US011230685B2

(12) United States Patent
He

(10) Patent No.: US 11,230,685 B2
(45) Date of Patent: Jan. 25, 2022

(54) HIGHLY WEAR-RESISTANT PLANT GENETIC LUBRICANT OIL ADDITIVE, PREPARATION METHOD AND APPLICATION THEREOF

(71) Applicant: CHANGDE JIZHI BIOTECHNOLOGY LIMITED COMPANY, Hunan (CN)

(72) Inventor: Xinqiao He, Guangdong (CN)

(73) Assignee: Changde Jizhi Biotechnology Limited Company, Hunan (CN)

( * ) Notice: Subject to any disclaimer, the term of this patent is extended or adjusted under 35 U.S.C. 154(b) by 0 days.

(21) Appl. No.: 16/643,828

(22) PCT Filed: Oct. 31, 2018

(86) PCT No.: PCT/CN2018/112978

§ 371 (c)(1),
(2) Date: Mar. 2, 2020

(87) PCT Pub. No.: WO2019/174256

PCT Pub. Date: Sep. 19, 2019

(65) Prior Publication Data

US 2021/0062105 A1 Mar. 4, 2021

(30) Foreign Application Priority Data

Mar. 12, 2018 (CN) ..... 201810200197.1

(51) Int. Cl.

| | |
|---|---|
| ***C10M 169/04*** | (2006.01) |
| ***C10M 159/08*** | (2006.01) |
| ***C10M 177/00*** | (2006.01) |
| *C10N 30/06* | (2006.01) |
| *C10N 40/25* | (2006.01) |

(52) U.S. Cl.

CPC ..... *C10M 169/042* (2013.01); *C10M 159/08* (2013.01); *C10M 177/00* (2013.01); *C10M 2203/003* (2013.01); *C10M 2207/40* (2013.01); *C10N 2030/06* (2013.01); *C10N 2040/25* (2013.01)

(58) Field of Classification Search

CPC ..... C10M 169/042; C10M 159/08; C10M 177/00; C10M 2203/003; C10M 2207/40; C10M 2201/105; C10M 2207/401; C10M 2207/404; C10N 2040/25; C10N 2020/06; C10N 2030/06

See application file for complete search history.

(56) References Cited

U.S. PATENT DOCUMENTS

| | | | | |
|---|---|---|---|---|
| 2009/0053268 | A1* | 2/2009 | DePablo | C11C 5/002 424/401 |
| 2010/0105583 | A1* | 4/2010 | Garmier | C10M 169/04 508/155 |
| 2011/0118156 | A1* | 5/2011 | Ruhle | C10M 171/06 508/136 |

* cited by examiner

*Primary Examiner* — Vishal V Vasisth

(57) ABSTRACT

A highly wear-resistant plant genetic lubricant oil additive, a preparation method and an application thereof are disclosed. The additive includes 90-97% of a plant base oil and 3-10% of an aerogel. The plant base oil is prepared from a mixed plant oil of soybean oil, rapeseed oil, sesame oil, peanut oil, olive oil, castor seed oil, salad oil, sunflower seed oil and tung oil. The highly wear-resistant plant genetic lubricant oil additive is added to various lubricant oils for being used to devices, and a colloidal substance is generated after the devices are driven and heat is generated, so that the lubricant oils are firmly adhered to the surface of components. The lubricant oil additive not only has characteristics of high abrasion resistance, high and low temperature resistance, and oxidation resistance, but also the used lubricant oil can be regenerated and recycled after being recovered and filtered.

1 Claim, No Drawings

HIGHLY WEAR-RESISTANT PLANT GENETIC LUBRICANT OIL ADDITIVE, PREPARATION METHOD AND APPLICATION THEREOF

CROSS REFERENCE OF RELATED APPLICATION

This is a U.S. National Stage under 35 U.S.C 371 of the International Application PCT/CN2018/112978, filed Oct. 31, 2018, which claims priority under 35 U.S.C. 119(a-d) to CN 201810200197.1, filed Mar. 12, 2018.

BACKGROUND OF THE PRESENT INVENTION

Field of Invention

The present invention relates to the field of lubricant oil technology, and more particularly to a highly wear-resistant plant genetic lubricant oil additive, a preparation method and an application thereof.

Description of Related Arts

Synthetic motor oil is also called synthetic lubricant oil. If water is the source of life, then lubricant oil is the source of transportation and machinery. Lubricant oils are required for both mechanical equipment and transportation and mainly used to reduce the friction between the surfaces of moving parts. At the same time, they have functions of cooling, sealing, anti-corrosion, anti-rust, insulation, power transmission and cleaning impurities. Traditional lubricant oils are mostly obtained by distilling or refining petroleum, vegetable oils and animal fats. Since the traditional lubricant oils are separated from components after the equipment transmission generates high temperature, the added lubricant oils need to cover the components; in the high-speed transmission process, when the lubricant oils are separated, the components are worn and noise is generated, so that carbon deposits are generated. Accordingly, the lubricant oils are oxidized and lose the function of lubrication. Therefore, the mechanical equipment and transportation need to change the lubricant oils frequently. Once the components are damaged, the service life of mechanical equipment and transportation is shortened; and moreover, synthetic lubricant oils cannot be degraded after use, and cannot be regenerated and recycled, which seriously pollutes the environment.

SUMMARY OF THE PRESENT INVENTION

To solve the above technical problems, a first object of the present invention is to provide a highly wear-resistant plant genetic lubricant oil additive. The lubricant oil additive not only has good lubricating function, but also has high abrasion resistance, avoiding damage to parts of mechanical equipment; and it is able to be regenerated and recycled, which greatly reduces the mining and smelting of metal minerals, and is environmentally friendly and energy saving.

A second object of the present invention is to provide a preparation method of the highly wear-resistant plant genetic lubricant oil additive.

A third object of the present invention is to provide an application of the highly wear-resistant plant genetic lubricant oil additive which is able to be added to various lubricant oils and is also able to be used directly as a lubricant oil or a motor oil.

The present invention is achieved by technical solutions as follows.

A highly wear-resistant plant genetic lubricant oil additive comprises by volume percentage:

92-97% of a plant base oil prepared from a mixed plant oil of soybean oil, rapeseed oil, sesame oil, peanut oil, olive oil, castor seed oil, salad oil, sunflower seed oil and tung oil; and 3-8% of an aerogel.

Preferably, the aerogel is a porous material with a pore diameter in a range of 50-150 nm, and more preferably, 100 nm.

Preferably, the mixed plant oil comprises 5-15% of the soybean oil, 5-15% of the rapeseed oil, 5-15% of the sesame oil, 5-20% of the peanut oil, 5-15% of the olive oil, 5-20% of the castor seed oil, 5-15% of the salad oil, 5-20% of the sunflower seed oil, and 5-8% of the tung oil by volume percentage.

The mixed plant oil is prepared by a method comprising steps of:

(1) preparing a synthetic plant oil, which comprises: pouring the soybean oil, the rapeseed oil, the sesame oil, the peanut oil, the olive oil, the castor seed oil, the salad oil and the sunflower seed oil with the volume percentage into a dispersing machine, stirring for 8-12 min at a rotational speed of 1000 rpm, and then stirring for 8-12 min at a rotational speed of 2000 rpm, and then stirring for 12-20 min at a rotational speed of 3000 rpm for sufficiently evenly stirring, and obtaining the synthetic plant oil;

(2) performing a first reaction, which comprises: adding the tung oil with the volume percentage to the synthetic plant oil obtained by the step (1), heating to 75-85° C., dispersing and stirring at the rotational speed of 3000 rpm for 25-35 min, and obtaining a first reacted plant oil;

(3) performing a first freeze, which comprises: pouring the first reacted plant oil into a container, placing into a cold storage with a temperature in a range of −55° C.--65° C. after naturally cooling, freezing for 70-75 h, and obtaining a first frozen plant oil;

(4) performing a second reaction, which comprises: pouring into the dispersing machine after unfreezing the first frozen plant oil, heating to 45-55° C., stirring at the rotational speed of 2000 rpm for 25-35 min, and obtaining a second reacted plant oil; and (5) performing a second freeze, which comprises: pouring the second reacted plant oil into an iron drum, placing into the cold storage with a temperature in a range of −75° C.--85° C. after naturally cooling, freezing for 140-145 h again, and obtaining the mixed plant oil.

The plant base oil is prepared by a method comprising steps of placing into a sealed reactor with at least one exhaust pipe after unfreezing the mixed plant oil, heating to 790-810° C., placing a vessel at a joint of the exhaust pipe, and discharging oil fume into the vessel, wherein the oil fume is the plant base oil. Preferably, there are two exhaust pipes both of which are 70-90 cm away from ground, and more preferably, 80 cm.

A preparation method of the highly wear-resistant plant genetic lubricant oil additive comprises steps of:

(A) performing an extraction after placing the plant base oil into a gene extraction tank, and obtaining a plant gene oil;

(B) placing the plant gene oil obtained by the step (A) into the dispersing machine, adding the aerogel with the volume percentage to the plant gene oil, heating to 90-110° C., stifling at the rotational speed of 3000 rpm for 55-65 min, and obtaining an intermediate product;

(C) placing into the cold storage with a temperature in a range of −75° C.--85° C. after naturally cooling the intermediate product obtained by the step (B), freezing for 140-145 h, and obtaining a frozen product;

(D) taking out the frozen product obtained by the step (C), naturally unfreezing, placing into the dispersing machine, heating to 175-185° C., stirring at the rotational speed of 1000 rpm for 8-12 min, and then stirring at the rotational speed of 2000 rpm for 15-25 min, and then stirring at the rotational speed of 3000 rpm for 25-35 min, and obtaining a stirred product; and (E) canning after taking out the stirred product, and obtaining the highly wear-resistant plant genetic lubricant oil additive.

The highly wear-resistant plant genetic lubricant oil additive provided by the present invention is able to be used directly as the motor oil, and is also able to be used as the lubricant oil additive for machinery equipment and transportation. It is able to be used in different devices with different added amounts as required.

According to the present invention, firstly multiple plant oils with fixed volume percentages are mixed, and then repeatedly dispersed and frozen, and then performed the extraction for extracting the genes of the mixed plant oil which is dispersed and frozen for many times, and then the nano-aerogel material is added, so as to finally obtain the highly wear-resistant plant genetic lubricant oil additive provided by the present invention. The highly wear-resistant plant genetic lubricant oil additive is added to various kinds of lubricant oils, or directly used to the equipment. When the equipment runs, the highly wear-resistant plant genetic lubricant oil additive provided by the present invention generates a colloidal substance after the transmission heat is generated, so that the lubricant oil additive is firmly adhered to the surface of parts. Moreover, it has the characteristics of high abrasion resistance, high and low temperature resistance (up to the high temperature of 600° C. and the low temperature of −60° C.), and oxidation resistance. Its abradability coefficient is more than 10 times that of existing lubricant oils and its service life is 5 times that of ordinary lubricant oils. In addition, the used lubricant oil is able to be regenerated and recycled after it is recovered and filtered. It is more significant that the mucous membranes of this product rub against each other to reduce the noise and repair the equipment, so that after the transportation is added with the lubricant oil additive provided by the present invention, the noise is greatly reduced.

DETAILED DESCRIPTION OF THE PREFERRED EMBODIMENT

The present invention is further described in detail in combination with specific embodiments as follows, so as to help those skilled in the art to understand the present invention.

First Embodiment:

A highly wear-resistant plant genetic lubricant oil additive, calculated by volume percent, comprises 15% of soybean oil, 15% of rapeseed oil, 15% of sesame oil, 5% of peanut oil, 15% of olive oil, 5% of castor seed oil, 15% of salad oil, 5% of sunflower seed oil, 7% of tung oil and 3% of aerogel, wherein the aerogel is a porous material with a pore diameter of 50 nm.

A preparation method of the highly wear-resistant plant genetic lubricant oil additive comprises steps of:

(S1) preparing a mixed plant oil, which comprises:

(1) preparing a synthetic plant oil, which comprises: pouring the soybean oil, the rapeseed oil, the sesame oil, the peanut oil, the olive oil, the castor seed oil, the salad oil and the sunflower seed oil with the volume percentage into a dispersing machine, stirring for 8 min at a rotational speed of 1000 rpm, and then stirring for 8 min at a rotational speed of 2000 rpm, and then stirring for 12 min at a rotational speed of 3000 rpm for sufficiently evenly stirring, and obtaining the synthetic plant oil;

(2) performing a first reaction, which comprises: adding the tung oil with the volume percentage to the synthetic plant oil obtained by the step (1), heating to 75° C., dispersing and stirring at the rotational speed of 3000 rpm for 25 min, and obtaining a first reacted plant oil;

(3) performing a first freeze, which comprises: pouring the first reacted plant oil into a container, placing into a cold storage with a temperature of −55° C. after naturally cooling, freezing for 70 h, and obtaining a first frozen plant oil;

(4) performing a second reaction, which comprises: pouring into the dispersing machine after unfreezing the first frozen plant oil, heating to 45° C., stirring at the rotational speed of 2000 rpm for 25 min, and obtaining a second reacted plant oil; and (5) performing a second freeze, which comprises: pouring the second reacted plant oil into an iron drum, placing into the cold storage with a temperature of −75° C. after naturally cooling, freezing for 140 h again, and obtaining the mixed plant oil;

(S2) preparing a plant base oil, which comprises: placing into a sealed reactor with two exhaust pipes (both of which are 70 cm away from ground) after unfreezing the mixed plant oil, heating to 790° C., placing a vessel at a joint of the two exhaust pipes, and discharging oil fume into the vessel, wherein the oil fume is the plant base oil; and (S3) obtaining the highly wear-resistant plant genetic lubricant oil additive, which comprises:

(A) performing an extraction after placing the plant base oil into a gene extraction tank, and obtaining a plant gene oil, wherein the extraction is performed with a conventional solvent; the step (A) specifically comprises: placing the plant base oil into the gene extraction tank, contacting the plant base oil with the solvent, and then the plant base oil entering an evaporation tower after being extracted, evaporating the solvent with a low boiling point after heating, and then evaporating residual solvent after the plant base oil entering an essential oil evaporator, and obtaining the plant gene oil;

(B) placing the plant gene oil obtained by the step (A) into the dispersing machine, adding the aerogel with the volume percentage to the plant gene oil, heating to 90° C., stirring at the rotational speed of 3000 rpm for 55 min, and obtaining an intermediate product;

(C) placing into the cold storage with a temperature of −75° C. after naturally cooling the intermediate product obtained by the step (B), freezing for 140 h, and obtaining a frozen product;

(D) taking out the frozen product obtained by the step (C), naturally unfreezing, placing into the dispersing machine, heating to 175° C., stirring at the rotational speed of 1000 rpm for 8 min, and then stirring at the rotational speed of 2000 rpm for 15 min, and then stirring at the rotational speed of 3000 rpm for 25 min, and obtaining a stirred product; and (E) canning after taking out the stirred product, so that the highly wear-resistant plant genetic lubricant oil additive is obtained.

Second Embodiment:

A highly wear-resistant plant genetic lubricant oil additive, calculated by volume percent, comprises 20% of soybean oil, 10% of rapeseed oil, 10% of sesame oil, 10% of peanut oil, 10% of olive oil, 10% of castor seed oil, 10% of salad oil, 10% of sunflower seed oil, 5% of tung oil and 5% of aerogel, wherein the aerogel is a porous material with a pore diameter of 100 nm.

A preparation method of the highly wear-resistant plant genetic lubricant oil additive comprises steps of:

(S1) preparing a mixed plant oil, which comprises:

(1) preparing a synthetic plant oil, which comprises: pouring the soybean oil, the rapeseed oil, the sesame oil, the peanut oil, the olive oil, the castor seed oil, the salad oil and the sunflower seed oil with the volume percentage into a dispersing machine, stirring for 10 min at a rotational speed of 1000 rpm, and then stirring for 10 min at a rotational speed of 2000 rpm, and then stirring for 10 min at a rotational speed of 3000 rpm for sufficiently evenly stirring, and obtaining the synthetic plant oil;

(2) performing a first reaction, which comprises: adding the tung oil with the volume percentage to the synthetic plant oil obtained by the step (1), heating to 80° C., dispersing and stiffing at the rotational speed of 3000 rpm for 30 min, and obtaining a first reacted plant oil;

(3) performing a first freeze, which comprises: pouring the first reacted plant oil into a container, placing into a cold storage with a temperature of −60° C. after naturally cooling, freezing for 74 h, and obtaining a first frozen plant oil;

(4) performing a second reaction, which comprises: pouring into the dispersing machine after unfreezing the first frozen plant oil, heating to 50° C., stirring at the rotational speed of 2000 rpm for 30 min, and obtaining a second reacted plant oil; and (5) performing a second freeze, which comprises: pouring the second reacted plant oil into an iron drum, placing into the cold storage with a temperature of −80° C. after naturally cooling, freezing for 144 h again, and obtaining the mixed plant oil;

(S2) preparing a plant base oil, which is the same as the first embodiment, wherein differences are that the two exhaust pipes are 80 cm away from ground and heating to 800° C.; and (S3) obtaining the highly wear-resistant plant genetic lubricant oil additive, wherein the step (A) is the same as that of the first embodiment, and differences are that:

(B) placing the plant gene oil obtained by the step (A) into the dispersing machine, adding the aerogel with the volume percentage to the plant gene oil, heating to 100° C., stirring at the rotational speed of 3000 rpm for 60 min, and obtaining an intermediate product;

(C) placing into the cold storage with a temperature of −80° C. after naturally cooling the intermediate product obtained by the step (B), freezing for 144 h, and obtaining a frozen product;

(D) taking out the frozen product obtained by the step (C), naturally unfreezing, placing into the dispersing machine, heating to 180° C., stirring at the rotational speed of 1000 rpm for 10 min, and then stirring at the rotational speed of 2000 rpm for 20 min, and then stirring at the rotational speed of 3000 rpm for 30 min, and obtaining a stirred product; and (E) canning after taking out the stirred product, so that the highly wear-resistant plant genetic lubricant oil additive is obtained.

Third Embodiment:

A highly wear-resistant plant genetic lubricant oil additive, calculated by volume percent, comprises 5% of soybean oil, 5% of rapeseed oil, 5% of sesame oil, 20% of peanut oil, 5% of olive oil, 20% of castor seed oil, 5% of salad oil, 20% of sunflower seed oil, 5% of tung oil and 10% of aerogel, wherein the aerogel is a porous material with a pore diameter of 150 nm.

A preparation method of the highly wear-resistant plant genetic lubricant oil additive comprises steps of:

(S1) preparing a mixed plant oil, which comprises:

(1) preparing a synthetic plant oil, which comprises: pouring the soybean oil, the rapeseed oil, the sesame oil, the peanut oil, the olive oil, the castor seed oil, the salad oil and the sunflower seed oil with the volume percentage into a dispersing machine, stirring for 12 min at a rotational speed of 1000 rpm, and then stirring for 12 min at a rotational speed of 2000 rpm, and then stirring for 20 min at a rotational speed of 3000 rpm for sufficiently evenly stirring, and obtaining the synthetic plant oil;

(2) performing a first reaction, which comprises: adding the tung oil with the volume percentage to the synthetic plant oil obtained by the step (1), heating to 85° C., dispersing and stirring at the rotational speed of 3000 rpm for 35 min, and obtaining a first reacted plant oil;

(3) performing a first freeze, which comprises: pouring the first reacted plant oil into a container, placing into a cold storage with a temperature of −65° C. after naturally cooling, freezing for 75 h, and obtaining a first frozen plant oil;

(4) performing a second reaction, which comprises: pouring into the dispersing machine after unfreezing the first frozen plant oil, heating to 55° C., stirring at the rotational speed of 2000 rpm for 35 min, and obtaining a second reacted plant oil; and (5) performing a second freeze, which comprises: pouring the second reacted plant oil into an iron drum, placing into the cold storage with a temperature of −85° C. after naturally cooling, freezing for 145 h again, and obtaining the mixed plant oil;

(S2) preparing a plant base oil, which is the same as the first embodiment, wherein differences are that the two exhaust pipes are 90 cm away from ground and heating to 810° C.; and (S3) obtaining the highly wear-resistant plant genetic lubricant oil additive, wherein the step (A) is the same as that of the first embodiment, and differences are that:

(B) placing the plant gene oil obtained by the step (A) into the dispersing machine, adding the aerogel with the volume percentage to the plant gene oil, heating to 110° C., stirring at the rotational speed of 3000 rpm for 65 min, and obtaining an intermediate product;

(C) placing into the cold storage with a temperature of −85° C. after naturally cooling the intermediate product obtained by the step (B), freezing for 145 h, and obtaining a frozen product;

(D) taking out the frozen product obtained by the step (C), naturally unfreezing, placing into the dispersing machine, heating to 185° C., stirring at the rotational speed of 1000 rpm for 12 min, and then stirring at the rotational speed of 2000 rpm for 25 min, and then stirring at the rotational speed of 3000 rpm for 35 min, and obtaining a stirred product; and (E) canning after taking out the stirred product, so that the highly wear-resistant plant genetic lubricant oil additive is obtained.

The above embodiments are merely preferred embodiments of the present invention, and are not intended to limit the protective scope of the present invention. Therefore, any equivalent changes or modifications made based on the features and principles described in the claims of the present invention should be included in the protective scope defined by the claims of the present invention.

Through testing, the physical and chemical properties of the present invention are as follows.

Kinematic viscosity (100° C.): 13.94 $m^2/s$ (detection method is GB/T 265-1988 (2004));

High shear viscosity at high temperature (150° C.): 3.74 mPa·s (detection method is SH/T 0703-2001 (2007));

Dynamic viscosity at low temperature (−20° C.): 2990 mPa·s (detection method is GB/T 06538-2010);

Pumping viscosity at low temperature (−25° C., no yield stress): 11200 mPa·s (detection method is NB/SH/T 0562-2013);

Pour point: −36° C. (detection method is GB/TO 3535-2006);

Foamy (buddle tendency/foam stability):

24° C.: 5/0 ml/ml, 93.5° C.: 20/0 ml/ml, latter 24° C.: 5/0 ml/ml;

Flash point (opening): 226° C. (GB/T 3536-2008);

Intensity (20° C.): 874.2 kg/m$^2$ (SH/T 0604-2000);

Carrying capacity (Four-ball method):

Maximum no bite load P: 981 (100) N (Kgf);

Sintering load PD: 3089 (315) N (Kgf);

Comprehensive wear index ZMZ: 567 (57.78).

Using the same test method, the highly wear-resistant plant genic lubricant oil additive provided by the present invention is respectively tested at 600° C. and −60° C., and its physical and chemical properties meet relevant standards.

What is claimed is:

1. A preparation method of a highly wear-resistant plant genetic lubricant oil additive, wherein:

the highly wear-resistant plant genetic lubricant oil additive comprises 92-97% of a plant base oil and 3-8% of an aerogel by volume percentage;

the preparation method comprises steps of:

(1) preparing the plant base oil, which comprises:

(1A) preparing a mixed plant oil, which comprises 5-15% of soybean oil, 5-15% of rapeseed oil, 5-15% of sesame oil, 5-20% of peanut oil, 5-15% of olive oil, 5-20% of castor seed oil, 5-15% of salad oil, 5-20% of sunflower seed oil, and 5-8% of tung oil by volume percentage, comprising:

(a) preparing a synthetic plant oil, which comprises pouring the soybean oil, the rapeseed oil, the sesame oil, the peanut oil, the olive oil, the castor seed oil, the salad oil and the sunflower seed oil into a dispersing machine, stirring for 8-12 min at a rotational speed of 1000 rpm, and then stirring for 8-12 min at a rotational speed of 2000 rpm, and then stirring for 12-20 min at a rotational speed of 3000 rpm for sufficiently evenly stirring, thereby obtaining the synthetic plant oil;

(b) performing a first reaction, which comprises adding the tung oil to the synthetic plant oil obtained by the step (a), heating to 75-85° C., and obtaining a first reacted plant oil by dispersing and stirring at a rotational speed of 3000 rpm for 25-35 min;

(c) performing a first freeze, which comprises pouring the first reacted plant oil into a container, placing into a cold storage with a temperature in a range of −65° C.--55° C. after naturally cooling, and obtaining a first frozen plant oil by freezing for 70-75 h;

(d) performing a second reaction, which comprises pouring into the dispersing machine after unfreezing the first frozen plant oil, heating to 45-55° C., and obtaining a second reacted plant oil by stirring at the rotational speed of 2000 rpm for 25-35 min; and (e) performing a second freeze, which comprises pouring the second reacted plant oil into an iron drum, placing into the cold storage with the temperature in the range of −75° C.--85° C. after naturally cooling, and freezing for 140-145 h again, thereby obtaining the mixed plant oil; and (1B) placing into a sealed reactor with at least one exhaust pipe after unfreezing the mixed plant oil, heating to 790-810° C., placing a vessel at a joint of the exhaust pipe, and discharging oil fume into the vessel, wherein the oil fume is the plant base oil;

(2) placing the plant base oil into a gene extraction tank, and then obtaining a plant gene oil by performing an extraction;

(3) placing the plant gene oil obtained by the step (2) into the dispersing machine, adding the aerogel into the dispersing machine, heating to 90-110° C., and obtaining an intermediate product by stirring at the rotational speed of 3000 rpm for 55-65 min;

(4) naturally cooling the intermediate product obtained by the step (3), placing the naturally cooled intermediate product into the cold storage with a temperature in a range of −85° C. to −75° C., and obtaining a frozen product by freezing for 140-145 h;

(5) taking out the frozen product obtained by the step (4), naturally unfreezing, placing into the dispersing machine, heating to 175-185° C., stirring at the rotational speed of 1000 rpm for 8-12 min, and then stirring at the rotational speed of 2000 rpm for 15-25 min, and then obtaining a stirred product by stirring at the rotational speed of 3000 rpm for 25-35 min; and (6) canning after taking out the stirred product, thereby obtaining the highly wear-resistant plant genetic lubricant oil additive.

* * * * *